United States Patent [19]

Akkawi

[11] Patent Number: 4,891,096

[45] Date of Patent: Jan. 2, 1990

[54] PROCESS FOR BIOCHEMICAL RETTING OF PHLOEM-FIBER PLANTS

[75] Inventor: Jean-Sony Akkawi, La Gaubretiere, France

[73] Assignee: Comite Economique Agricole De La Production Du Chanvre, Le Mans, France; a part interest

[21] Appl. No.: 327,403

[22] Filed: Mar. 22, 1989

Related U.S. Application Data

[63] Continuation of Ser. No. 68,270, filed as PCT FR86/00358 on Oct. 17, 1986, published as WO87/02390 on Apr. 23, 1987, abandoned.

[30] Foreign Application Priority Data

Oct. 18, 1985 [FR] France ..... 85 15788

[51] Int. Cl.[4] ..... D01C 1/04

[52] U.S. Cl. ..... 162/1; 19/1; 19/66 R; 162/72; 162/98; 435/277; 435/279

[58] Field of Search ..... 162/1, 98; 435/263, 435/277, 279; 19/1, 66 R

[56] References Cited

U.S. PATENT DOCUMENTS

| | | | |
|---|---|---|---|
| 2,280,307 | 4/1942 | Diehm | 195/8 |
| 4,568,739 | 2/1986 | Juskowski | 435/277 |
| 4,628,029 | 12/1986 | Eveleigh et al. | 435/277 |

FOREIGN PATENT DOCUMENTS

| | | |
|---|---|---|
| 220913 | 5/1987 | European Pat. Off. . |
| 0696959 | 1/1931 | France . |
| 2518570 | 6/1983 | France . |
| 0721878 | 1/1955 | United Kingdom . |
| 2115820 | 9/1983 | United Kingdom . |

OTHER PUBLICATIONS

"Great Scope for Flax", *Textile Horizons,* May, 1984, Vol. 4, No. 5, pp. 22–23.

*Primary Examiner*—Steve Alvo
*Attorney, Agent, or Firm*—Young & Thompson

[57] ABSTRACT

The process for biochemical retting of phloem-fiber plants such as hemp, flax, ramie, jute, kenaf, etc. permits separation of the fibers of the bundle for subsequent utilization in the textile or paratextile industry. The process comprises treating the fibrous plants with at least one SPS-ase enzyme and preferably a mixture of enzymes comprising $\beta$-glucanase, pectinase and SPS-ase.

19 Claims, No Drawings

PROCESS FOR BIOCHEMICAL RETTING OF PHLOEM-FIBER PLANTS

This application is a continuation of application No. 068,270, filed as PCT FR86/00358 on Oct. 17, 1986, published as WO87/02390 on Apr. 23, 1987, now abandoned.

The present invention relates to a process for biochemical retting of phloem-fiber plants such as hemp, flax, ramie, jute and kenaf.

The invention relates in particular to a biochemical process, the application of which is intended to permit the use, in the textile or paratextile industry or rope-manufacturing industry, of phloem-fiber plants, cellulose-fiber plants and the like which have not been subjected to the natural retting process that permits separation of the fibers within the bundle.

In the prior art, phloem-fiber plants were subjected after harvesting to natural retting either on the ground by exposure to weathering conditions or in water for allowing natural development of microorganisms which has the effect of disintegrating and "digesting" the natural cements which bind the fibers together within the bundle in phloem-fiber plants. This technique, which is directly related to atmospheric and hydrographic conditions, requires a period of action of the order of two to five weeks while also calling for substantial labor and equipment.

Hemp forms part of the fiber-plant family known as phloem-fiber plants in which the cellulose fibers are bonded together in bundles within the phloem which surrounds the stem of the plant.

The other principal fiber plants forming part of this phloem-fiber plant family are flax, ramie, jute and kenaf.

In order to be usable in the textile industry, the cellulose fibers of these plants have to be separated from the phloem, then from each other within the bundles. This separation is made possible by the natural retting process. This separation is subsequently performed mechanically by means of specially adapted textile equipment.

Natural retting, a well-known operation which has been practiced for centuries, consists in immersing the plant stems in the water of certain streams for relatively long periods of time. This immersion gives rise to the natural development of anaerobic bacteria and these latter generate microorganisms which are capable of degrading the vegetable macromolecules which bind the bundles together within the phloem and which bind the fibers to each other within the bundles.

Although still performed on a small scale, this so-called water-retting process is being gradually replaced by the so-called ground-retting process which consists in leaving the stems of phloem-fiber plants on the ground after reaping or pulling-out in order to produce the bacterial action developed by the ground microflora by virtue of the alternation of periods of rain and moist heat.

Throughout the duration of this exposure (several weeks) of the stems to weathering conditions, it is clearly essential to turn-over the windrows so that all the stems may be subjected to an action which is as uniform as possible.

This operation, which is relatively easy in the case of flax having stems measuring about 80 centimeters to 1 meter, can be performed only with difficulty in the case of hemp which has stems up to 2.50 meters to 3 meters in length.

Moreover, since harvesting of hemp takes place later in the year than flax: end of August to mid-September, the climatic conditions which govern "ground" retting become more and more uncertain by reason of the reduction in hours of sunshine and the increase in precipitations.

For these reasons and as a result of discontinuation of water-retting, hemp growers were induced to abandon the production of hemp for the textile industry in order to retain only the field of paper manufacture.

Thus the present Applicant, in an endeavor to find new outlets for the production of hemp and similar phloem-fiber plants, has sought the possibility of retting these plants by artificial means.

The present Applicant has thus endeavored to separate the fibers from the bundles by degradation of the cements which bind them together.

All purely chemical approaches have proved negative by reason of the fact that degradation of the cements by these means was always accompanied by substantial impairment of the cellulose fibers.

The object of the invention is therefore to provide an industrial process for retting phloem-fiber plants in order to solve the problems of reliability and reproducibility which are presented by the natural retting processes as a result of meteorological hazards.

In accordance with the invention, the process for biochemical retting of phloem-fiber plants and in particular hemp in order to obtain degradation of the cements which aggregate the fibers within the bundles and thus to permit their physical separation for use in the spinning or rope industry for the manufacture of spun yarns or slivers suitable for use in the textile or paratextile industry or the rope industry, is characterized in that the fibrous plants are treated by means of at least one SPS-ase enzyme.

The process which forms the subject of the invention is based on the principal use of this SPS-ase enzyme which makes it possible to break the macromolecular chains of the cements which interconnect the cellulose fibers in phloem-fiber plants such as hemp, flax, ramie, jut, kenaf, etc. while leaving intact, or as intact as possible, the cellulose which constitutes the fibers of interest for the textile or paratextile industry.

The SPS-ase enzyme employed for this purpose is specific to the non-cellulose fiber constituents which bind the fibers together within the fiber bundle.

In the remainder of the present description, the non-cellulose constituents of the fibers will be designated as "cements".

The chemical nature of these cements is not yet really known.

The SPS-ase enzyme employed in the process according to the invention is a broad-spectrum polyactive enzyme which produces action on the polysaccharides. This SPS-ase (i.e., soluble polysaccaridease) enzyme has been described in British Pat. No. 2,115,820. It is marketed by the Danish company Novo Industri A/S under the reference SP 249. This enzyme has four principal activities as follows:

- a pectolytic activity
- a cellulolytic activity
- a hemicellulolytic activity
- a proteolytic activity.

According to the researches carried out by the present Applicant, the pectolytic activity of this enzyme would appear to be more marked in regard to reduction in viscosity of the pectins, water-soluble portions of the pectic substances consisting essentially of polygalacturonic acid containing various quantities of methyl ester groups or in regard to depolymerization of water-soluble protopectins having a high degree of esterification.

Cellulolytic activity is observed especially in regard to the natural carboxymethylcelluloses of plants. This activity is advantageous in retting of hemp as a result of degradation of the CMCs which constitute a "glue" having very high strength and high adhesive power.

This cellulolytic activity is completed by a gluconic fungic activity and especially by a very slight cellubiase activity which makes it possible to prevent degradation of the cellulose fibers, these being the only fibers of interest and the object of the entire operation.

The hemicellulolytic activity has the object of producing degradation of the hemicelluloses, xylanes, as well as polyoses such as arabinase and α-galactoses.

This broad-spectrum polysaccharidase also has a proteolytic activity on the vegetable proteins.

The present Applicant has observed that the action of SPS-ase was enhanced when the treatment was performed by means of a mixture of this enzyme with beta-glucanase and/or pectinase.

β-glucanase produces action by hydrolysis of the β-glucanes at the level of the β1-3 and β1-4 bonds in soluble oligosaccharides and dissaccharides.

This hydrolysis is also accompanied by a notable reduction in viscosity of the baths.

Pectinase has a double activity on pectic substances, namely:

a non-depolymerizing activity, a depolymerizing activity.

By virtue of the non-depolymerizing activity of this enzyme, there is no reduction in length of the pectin chains but there is a reduction in their degree of esterification by opening of the ester bridge between the carboxyl groups of the unitary galacturonic acid and the methanol groups.

This reduction in the degree of esterification results in a reduction in viscosity and easier elimination of the water-soluble pectins during the retting process.

The three types of enzymes mentioned above thus have complementary activities and are further distinguished by the important property of providing conditions of application that are compatible with the treatment of phloem fibers, namely an optimum pH zone located between pH 4 and pH 6 and an optimum temperature range comprised between 40° and 60° C.

The treatment of phloem-fiber plant is carried out by impregnation and then maceration of the straws or tows in an aqueous medium containing the abovementioned enzyme or enzymes.

The period of maceration must be comprised between one hour and forty-eight hours, preferably between three and thirty-six hours.

Moreover, the maceration temperature must be comprised between 20° C and 70° C, preferably between 40° C and 60° C and this maceration is carried out at a pH comprised between 3 and 7, preferably between 4 and 6, this pH being adjusted by means of an organic acid.

The present Applicant has determined the application of the enzymes in an empirical manner by defining as his study proceeded the quality of the retting obtained, by the carding capability of the hemp tows treated in accordance with the invention.

These carding tests have been systematically carried out in a laboratory carding machine on hanks of tow treated in accordance with the invention.

A first series of tests has consisted in determining the action of broad-spectrum (SPS-ase) polysaccharidase on tows for the paper industry by subjecting to the action of an enzyme bath of a predefined concentration, identical quantities of tows and this, with the object of defining the optimum duration of the enzymic action.

To this end, enzymic macerations have been performed at hourly intervals from 1 to 12 hours, then at 18 hours - 24 hours - 30 - 36 - 48 - 60 - 72 - 84 and 96 hours.

Thus, by comparing the separation of the bundles by carding, an optimum period has been defined within the range of 18 to 30 hours. Over a period of less than 12 hours, there was observed poor separation of the bundles with breaking of the bundles during the carding operation.

Over a period of more than 36 hours, there was observed good separation of the bundles but many breaks in the fibers.

Systematic tests have been performed on hemp samples which differed from each other in coloring, blond-green hemp or dark brown hemp. In all cases, the best results in the carding test have been found with a time-duration of 22 to 26 hours.

In all cases, irrespective of the type of hemp, good separation of the bundles and of the fibers at the end of this period has been found.

It is commonly acknowledged that the action of an enzyme is proportional to its concentration. Furthermore, it is often stated that the speed of the enzymic action is directly related to the concentration of the enzymes.

In order to determine the optimum concentration, the present Applicant has subjected hemp samples for periods of 8 to 12 hours then 18–24 and 30 hours to SPS-ase enzyme baths having an increasing concentration at constant pH and temperature.

By using the carding test as an element of appreciation of the enzymic retting process, it has been found that at high concentration of the enzyme, macerations lasting less than 18 hours were less effective than macerations of 20 to 30 hours with lower concentrations.

The effectiveness of the other two enzymes, namely β-glucanase and pectinase, has been determined under the same conditions as SPS-ase polysaccharidase.

The results obtained in regard to separation of the bundles and fibers have been less conclusive than with (SPS-ase) polysaccharidase but there has been found a stronger action of β-glucanase on the degradation of the anas which become more brittle and more friable as well as a very distinct improvement in detachment of the strips or bundles of fibers from the anas and fragments of stems.

So far as pectinase is concerned, a more specific action has become apparent in regard to the colored "cuticle" which surrounds the fiber bundles as well as in regard to the silkiness and softness of the fibers, no doubt as a result of degradation and solubilization of this cuticle.

With a view to seeking the greatest efficiency for the enzymic retting process, the present Applicant has again carried out their systematic tests by means of mixtures of the three enzymes mentioned above until there was obtained by carding a sliver having long fibers which are well separated (without, however, going as far as unitary separation), silky and containing a minimum quantity of anas or rejects of anas.

The tests have served to determine that the quantities of enzymes employed with respect to the dry weight of straws or tows of phloem-fiber plants must be as follows:

(a) in the case of pectinase, comprised between 0.01 and 2% and preferably between 0.05% and 1%, (b) in the case of beta-glucanase, comprised between 0.10% and 3% and preferably between 0.25% and 2%, (c) in the case of the enzyme having a broader spectrum of action between 0.25% and 5%, and preferably between 0.5% and 3%.

The three enzymes which degrade the polymers as a result of their activity which is conducive to cleavage of well-defined bonds would also appear to improve solubilization and reduction in viscosity of the degradation products, thus resulting in more effective removal of these latter by rinsing on completion of maceration. In fact, the tows treated by the ternary mixture have a distinctly lesser tendency to "re-adhere" to each other at the time of drying which follows a brief rinsing operation than the tows treated with polysaccharidase alone.

The present Applicant has always obtained at the time of testing hemp fibers having high strength and good tenacity. This is undoubtedly due to the fact that the three enzymes selected have no action or practically no action on the cellulose but also to the fact that all the degradation reactions result in formation of reducing sugars. There is therefore practically no risk of formation of hydrocellulose and therefore of reduction of the D.P. of the cellulose by acid oxidation.

It is readily apparent that many modifications can be made in the practical application of the method described without thereby departing from the scope of the invention.

I claim:

1. A process for biochemical retting of hemp, in order to degrade the cements which bind the fibers within fiber bundles and thus permit the physical separation of such fibers, wherein said process comprises the step of contacting hemp plants with a mixture of enzymes comprising soluble polysaccharide-ase, β-glucanase and pectinase, wherein said contacting comprises impregnating said plants followed by maceration of the impregnated plants in an aqueous medium containing then enyzmes, wherein said maceration occurs for a time period of between 1 hour and 48 hours, at a temperature of between 20° C. and 70° C. and wherein said mixture of enzymes comprises between 0.01 and 2% of pectinase, between 0.10 and 3% of β-glucanase, and between 0.25 and 5% of soluble polysaccharide-ase.

2. The process according to claim 1, wherein said maceration occurs for a time period of between 3 and 36 hours.

3. The process according to claim 1, wherein said maceration occurs at a temperature of between 40° C. and 60° C.

4. The process according to claim 1, wherein said maceration occurs at a pH of between 3 and 7.

5. The process according to claim 1, wherein said maceration occurs at a pH of between 4 and 6.

6. The process according to claim 1, wherein said mixture of enzymes comprises between 0.05 and 1% of pectinase, between 0.25 and 2% of β-glucanase, and 0.5 and 3% of soluble polysaccharide-ase.

7. A process for biochemical retting of flax, in order to degrade the cements which bind the fibers within fiber bundles and thus permit the physical separation of such fibers, wherein said process comprises the step of contacting flax plants with a mixture of enzymes comprising soluble polysaccharide-ase, β-glucanase and pectinase, wherein said contacting comprises impregnating said plants followed by maceration of the impregnated plants in an aqueous medium containing the enzymes, wherein said maceration occurs for a time period of between 1 hour and 48 hours, at a temperature of between 20° C. and 70° C., and wherein said mixture of enzymes comprises between 0.01 and 2% of pectinase, between 0.10 and 3% of β-glucanase, and between 0.25 and 5% of soluble polysaccharide-ase.

8. The process according to claim 7, wherein said maceration occurs for a time period of between 3 and 36 hours.

9. The process according to claim 7, wherein said maceration occurs at a temperature of between 40° C. and 60° C.

10. The process according to claim 7, wherein said maceration occurs at a pH of between 3 and 7.

11. The process according to claim 7, wherein said maceration occurs at a pH of between 4 and 6.

12. The process according to claim 7, wherein said mixture of enzymes comprises between 0.05 and 1% of pectinase, between 0.25 and 2% of β-glucanase, and 0.5 and 3% of soluble polysaccharide-ase.

13. A process for biochemical retting of phloem-fiber plants, in order to degrade the cements which bind the fibers within fiber bundles and thus permit the physical separation of such fibers, wherein said process comprises the step of contacting said plants with a mixture of enzymes comprising soluble polysaccharide-ase, β-glucanase and pectinase, wherein said contacting comprises impregnating said plants followed by maceration of the impregnated plants in an aqueous medium containing the enzymes, wherein said maceration step occurs for a time period of between 1 hour and 48 hours, at a temperature of between 20° C. and 70° C., and wherein said mixture of enzymes comprises between 0.01 and 2% of pectinase, between 0.01 and 3% of β-glucanase, and between 0.25 and 5% of soluble polysaccharide-ase.

14. The process according to claim 13, wherein said maceration occurs for a time period of between 3 and 36 hours.

15. The process according to claim 13, wherein said maceration occurs at a temperature of between 40° C. and 60° C.

16. The process according to claim 13, wherein said maceration occurs at a pH of between 3 and 7.

17. The process according to claim 13, wherein said maceration occurs at a pH of between 4 and 6.

18. The process according to claim 13, wherein said mixture of enzymes comprises between 0.05 and 1% of pectinase, between 0.25 and 2% of β-glucanase, and 0.5 and 3% of soluble polysaccharide-ase.

19. The process according to claim 13, wherein said phloem-fiber plants are selected from the group consisting of ramie, jute kenaf mixtures thereof, mixtures thereof with hemp, mixtures thereof with flax and mixtures thereof with hemp and flax, and mixtures of hemp and flax.

* * * * *